United States Patent [19]

Morrison

[11] 4,046,277

[45] Sept. 6, 1977

[54] FLEXIBLE BOTTOM CONTAINERS

[75] Inventor: Hadley F. Morrison, Downey, Calif.

[73] Assignee: McDonnell Douglas Corporation, Long Beach, Calif.

[21] Appl. No.: 616,492

[22] Filed: Sept. 24, 1975

[51] Int. Cl.[2] ..... B65D 87/14

[52] U.S. Cl. ..... 220/1.5; 220/83; 244/118 R; 296/28 E

[58] Field of Search ..... 220/1.5, 83, 72; 105/367, 366, 392.5, 393, 467; 52/758 D, 63; 267/156, 157; 296/28 E; 244/118 R

[56] References Cited

U.S. PATENT DOCUMENTS

| | | | |
|---|---|---|---|
| 1,143,250 | 6/1915 | Butler | 229/DIG. 3 |
| 2,026,311 | 12/1935 | Harris | 52/758 D |
| 2,442,459 | 6/1948 | Fowler | 220/1.5 |
| 2,880,589 | 4/1959 | Wilson et al. | 52/758 D |
| 3,035,825 | 5/1962 | Weller | 105/367 |
| 3,119,473 | 1/1964 | Mitchell, Jr. | 52/758 D |
| 3,280,871 | 10/1966 | Taylor | 229/DIG. 3 |
| 3,294,034 | 12/1966 | Bodenheimer et al. | 244/118 R |
| 3,371,815 | 3/1968 | Macomber | 206/386 |
| 3,502,205 | 3/1970 | Milton | 206/386 |
| 3,651,974 | 3/1972 | Barry et al. | 220/1.5 |
| 3,712,463 | 1/1973 | Bestehorn | 206/232 |

FOREIGN PATENT DOCUMENTS

| | | | |
|---|---|---|---|
| 126,532 | 11/1900 | Germany | 105/366 |
| 247,610 | 6/1926 | United Kingdom | 296/28 E |

*Primary Examiner*—William Price
*Assistant Examiner*—Allan N. Shoap
*Attorney, Agent, or Firm*—John P. Scholl; Walter J. Jason; Donald L. Royer

[57] ABSTRACT

An improved hard sided cargo container having a top, bottom and four vertical walls, two opposing walls of said container being pliant to permit incremental vertical expansion or contraction of said walls responsive to loads on the floor of the container.

3 Claims, 14 Drawing Figures

FLEXIBLE BOTTOM CONTAINERS

BACKGROUND OF THE PRESENT INVENTION

In the past, cargo for air transporation was loaded and moved on pallets. To simplify the buildup, transportation and restraint of cargo, as well as reduce pilferage, shippers are now using enclosed solid walled cargo containers. Many of these containers are of substantial size to take advantage of the widebodied jumbo aircraft. Large solid walled deep sectioned cargo containers have substantial rigidity and a relatively inflexible floor.

Aircraft due to weight/load factors are constructed of lightweight structural elements which are inherently flexible. Accordingly, floor beams of the cargo compartments may deflect substantially under load.

When large solid walled deep sectioned cargo containers are used in aircraft there results a basic incompatibiltiy between the flexible aircraft floors and the relatively inflexible floors of the cargo containers. This incompatibility in the flexure of the two floors results in a concentration of the cargo loads at specific points and along certain lines on the aircraft floor. This point or line of contact load distribution may result in damage to the container or the aircraft floor.

SUMMARY OF THE PRESENT INVENTION

A principal object of the present invention is to provide means to increase the flexibility of the floor of the solid walled cargo container so that the flexibility of the cargo container floor matches the flexibility of the aircraft floor. When the flexibility of the two floors are substantially similar, the load on the cargo container floor will be more evenly distributed over a larger area on the aircraft cargo floor and thus decrease the likelihood of injury to the cargo containers or the aircraft floor as a result of highly concentrated loads.

Another object of the present invention is to relieve stresses that build up in solid walls of the containers as a result of flexing of the bottoms of the containers during loading and unloading operations as well as in turbulent flight.

The present invention solves the problems encountered in the prior art cargo containers by introducing a pliability to the cargo container walls which permits greater incremental flexing of the cargo container floor to match its loading or transporation environment.

The pliability is built into the solid cargo walls by incorporating pleats (flutes) or spring joints into the walls. These pleats or spring joints permit incremental vertical height adjustment of the wall and at the same time provide a solid wall with bending stiffness normal to the plane of the wall.

DETAILED DESCRIPTION OF ILLUSTRATIVE EMBODIMENT

Figure 1:
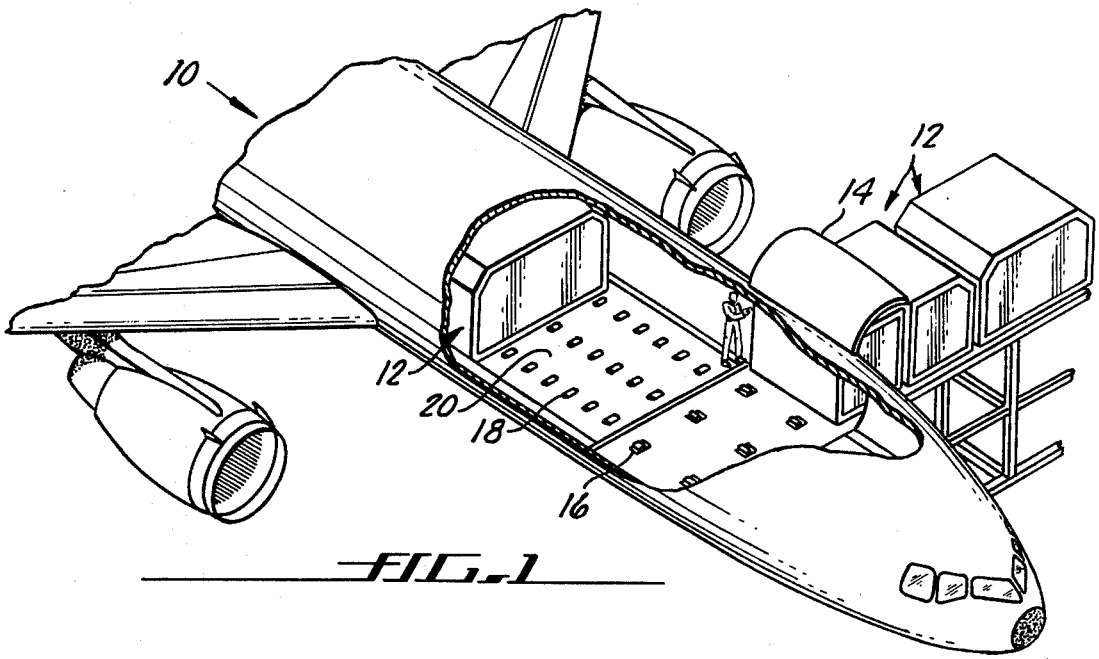
FIG. 1 is an oblique cutaway view of a DC-10 aircraft being loaded with cargo containers.

Referring to FIG. 1, a DC-10 cargo aircraft 10 is shown with containers 12 being loaded through a side door 14. Movement of the cargo containers 12 over the aircraft floor 20 into the proper position for flight may be accomplished by conventional power rollers 16 which raise to engage the bottom of the container and move it with the assistance of passive rollers 18 which also are raised to engage the bottom of the container and help in moving it.

Figure 2:
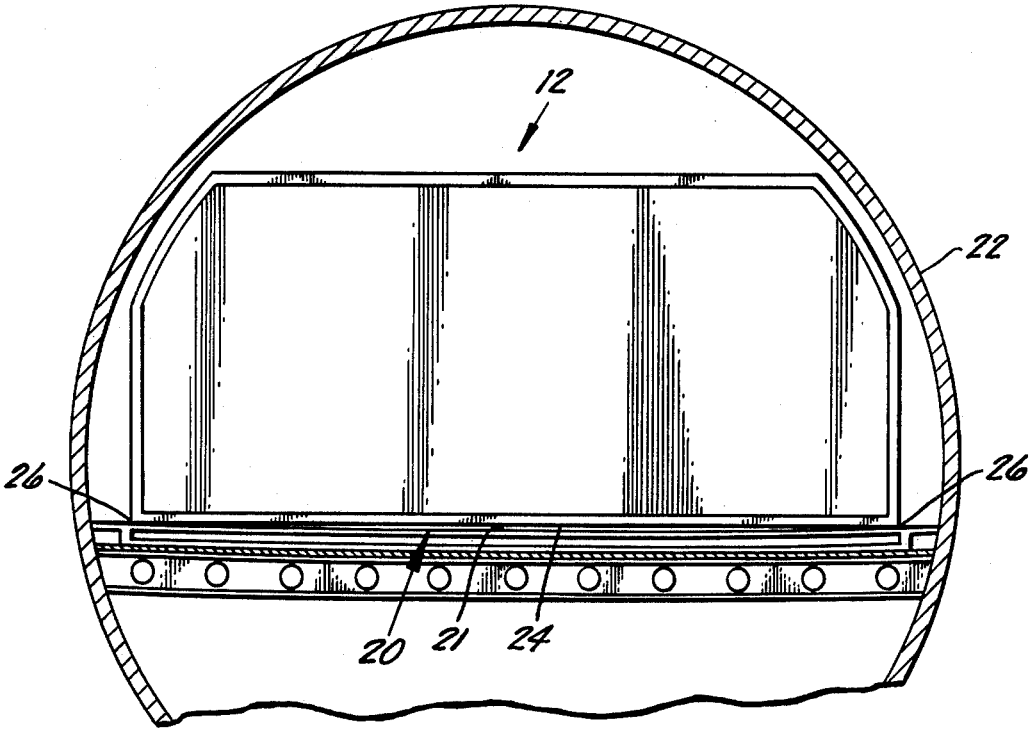
FIG. 2 PRIOR ART
FIG. 2 is a vertical section through the aircraft of FIG. 1 showing a cargo container in place in aircraft.

FIG. 2 depicts the end of a conventional cargo container 12 in position for shipment on the aircraft cargo floor 20. The dimensions of the end of conventional cargo containers of this type are approximately 18 feet across and 10 feet high. The cargo container 12 rests on aircraft cargo floor 20 and is enclosed by aircraft fuselage section 22. Due to the rigidity of the solid walled cargo container 12 and the relatively inflexible cargo container floor 24, there is a concentration of the load of the cargo container along the lines of contact 26 on the relatively flexible aircraft floor 20.

In FIG. 2 the more flexible aircraft floor 20 has been deflected a greater amount than the less flexible container floor 24 due to the load of the cargo container. This greater deflection of floor 20 is shown by the gap 21 (exaggerated) between the two floors.

Figure 3:
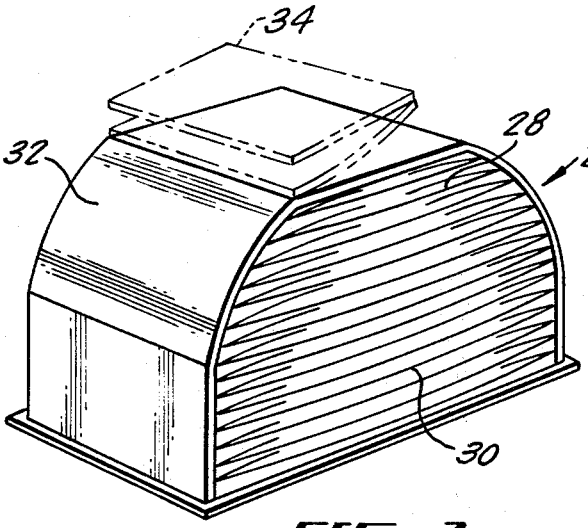
FIG. 3 is a perspective view of the pleated wall cargo container constructed according to the present invention with its loading door phantomed in the open position.
Figure 4:
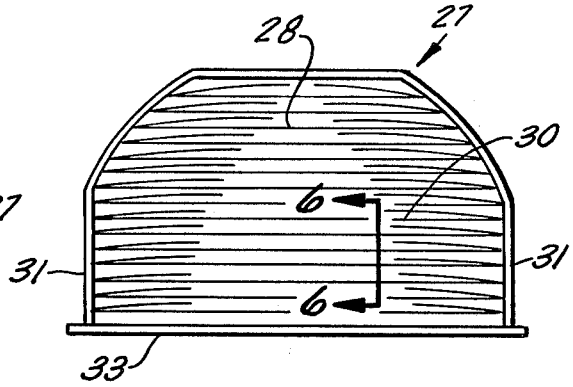
FIG. 4 is an elevational view of the pleated wall of the cargo container in a no-load configuration.

FIG. 3 depicts a cargo container 27 constructed in accordance with the present invention. This container has tapered pleats 28 incorporated in the surfaces of the two solid opposing walls 30. The cargo container 27 has a loading door 32 positioned in the side of the container 27 to allow access to the interior of the container. The loading door has also been phantomed in the open position 34. FIG. 4 depicts an end view of the container 27 with the tapered pleats 28. These pleats have their greatest depth at the center of end wall 30 and therefore can accommodate the greatest vertical distortion or warp in this area.

Figure 6:
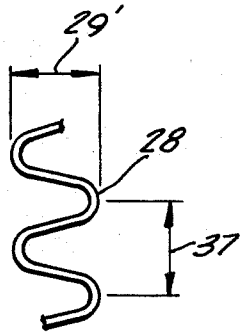
FIG. 6 is a sectional view of the wall of the container of FIG. 4 along the line 6—6.
Figure 5:
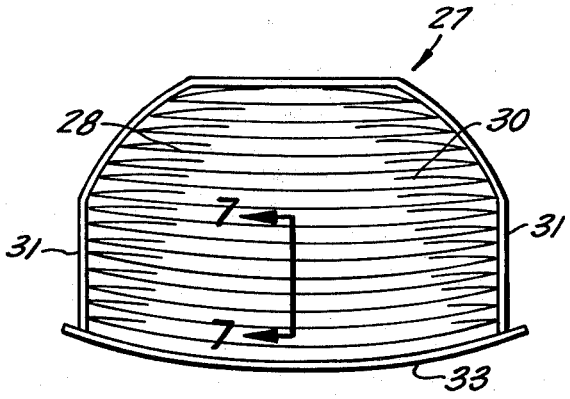
FIG. 5 is an elevational view of the pleated wall of the cargo container in a loaded condition with the pleats in a distorted or extended position and the floor flexed under load (exaggerated)
Figure 7:
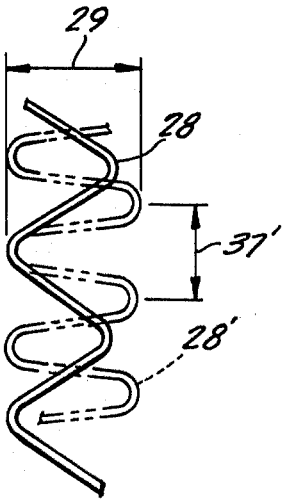
FIG. 7 is a sectional view of the wall of the container of FIG. 5 along the line 7—7.

FIG. 5 depicts an exaggerated view of a loaded cargo container 27 constructed in accordance with the present invention with its bottom 33 deflected and the pleats 28 distorted or extended. The pleats 28 incrementally extend across the wall to permit the bottom 33 of the container 27 to crescent under load. FIG. 6 and FIG. 7 are sectional views through the pleated end walls 30 of the containers of FIG. 4 and FIG. 5. In FIG. 7 the pleats 28 are depicted in their extended position (solid line) and are also shown in their unextended or undistorted position 28' (phantomed) for comparison. The taper of the pleats 28 can be seen from cross-sectional views in FIG. 6 and FIG. 7. The depth or width 29 (FIG. 7) of the pleat 28' (phantomed) is greatest at the center of the wall. (Location of section line 7—7.) The depth or width 29' (FIG. 6) of the pleat 28 diminishes toward the end (side) of the wall. At the end (edge) of the wall 31 the depth of the pleat is zero and the wall is a flat surface.

The pleats 28 shown in FIGS. 3, 4 and 5 are double tapered in that their depth or width (29) decreases in both directions from a maximum at the center of the wall (FIG. 7) to zero or a flat surface at the edge of the wall 31.

The pleat height (37 of FIG. 6 or 37' of FIG. 7) remains the same horizontally across the wall and vertically up the rise of the wall.

Double tapered pleats as described have two advantages over pleats of uniform dimensions. Tapered pleats 28 terminate in a flat surface at the edge of the wall and permit simpler construction of the container corners. In addition, taper pleats 28 permit greater incremental expansion at the center of the wall where the maximum deflection of the bottom 33 of the container 27 occurs (FIG. 5).

The tapered pleats 28 in the walls 30 of the container 27 can also contract to permit the bottom 33 of the container 27 to assume a concave position to accommodate the movement of the container over an irregularity in the floor during loading or unloading.

Figure 8:
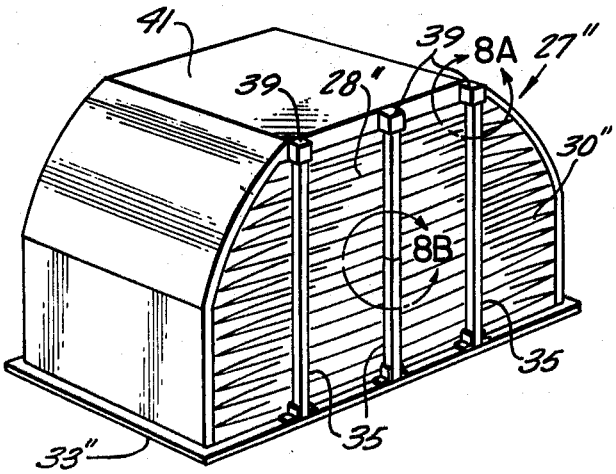
FIG. 8 is a perspective view of the cargo container having pleated walls which incorporate vertical telescoping support beams.
Figure 8A:
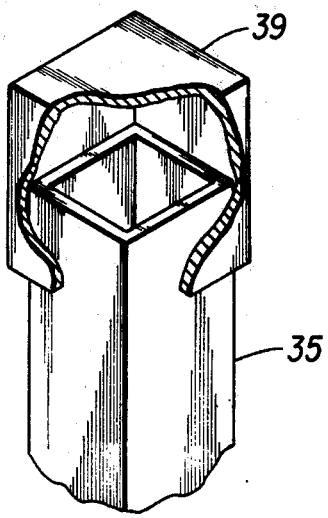
FIG. 8*a* is a breakaway expanded view of a box slip joint member of the container as outlined in FIG. 8.
Figure 8B:
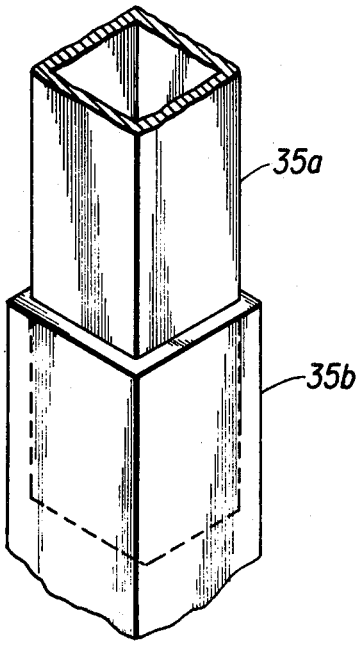
FIG. 8*b* is a breakaway expanded view of an alternative configuration of telescoping support beams as outlined in FIG. 8.

Even though a cargo container constructed in accordance with the present invention provides a solid wall with bending stiffness normal to the plane of the wall, due to the particular cargo involved, certain cargo containers may require walls with greater lateral support perpendicular to the wall of the container than can be provided by the pleated walls. FIG. 8 depicts a cargo container 27'' constructed in accordance with the present invention with pleated end walls 30''. The container 27'' has vertical telescoping support beams 35 constructed integrally with the pleated side walls to provide additional lateral support perpendicular to the pleated walls 30''. The beams 35 are attached to the bottom of the container 33'' and restrained by box slip joint members 39 to the top of the container 41. FIG. **8*a* is an expanded view of telescoping support beam 35 surrounded by box slip joint member 39. These beams 35 are located adjacent to the outside of the opposing pleated end walls 30'' and can support the pleated walls as necessary. The beams 35 incrementally extend or contract to accommodate flexure of the container bottom or floor 33''. The beams can also be constructed in two parts, one telescoping inside of the other FIG. 8*b*. In this alternative configuration beam 35*a* slips into beam 35*b*. Beam 35*a* is anchored in the box slip joint member at the top of the wall. The movement of the bottom of the container is compensated for by the lengthening or shortening of the telescoping support beams 35*a* and 35*b* by movement at the joint between said beams. Tapered pleats 28'' and end wall 30'' are constructed in the same manner as pleats 28 of FIG. 4.**

Figure 9:
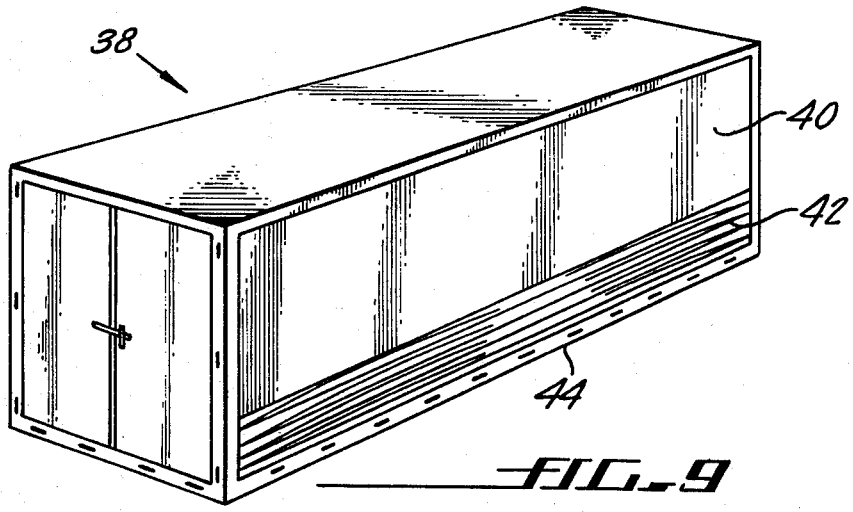
FIG. 9 is a perspective view of a large rectangular container with partially pleated walls constructed in accordance with the present invention.

Large rectangular containers have recently been adopted by trucking, airline, and shipping companies for land, air, and sea movement of cargo. These containers are approximately 8 feet in width and 20 to 40 feet in length. When cargo containers of this size are loaded into jumbo jets for air transportation the bottoms of the containers may be subject to bending or deflection in loading. In FIG. 9 a large rectangular container 38 is shown with partially pleated side walls 40. The double tapered pleats 42 which are incorporated into only a portion of the side wall 40 can expand or contract vertically to accommodate curvature of the floor 44 of the container 38. These double tapered pleats 42 are constructed similar to pleats 28 in FIGS. 4 and 5. When the large containers 38 are in place in a jumbo cargo aircraft 46, the container floors 44 may be subject to deflection due to the effect of the air turbulence on the aircraft fuselage and its cargo floor.

Figure 10:
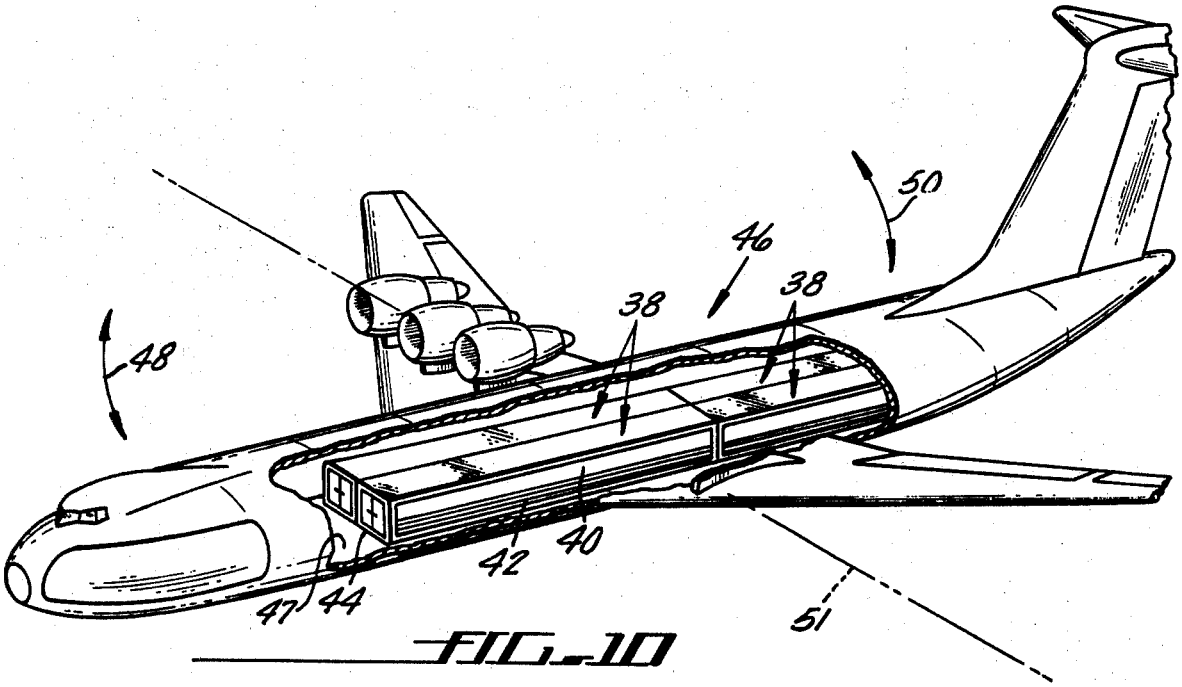
FIG. 10 is a cutaway perspective view of a jumbo cargo aircraft containing the large rectangular containers with partially pleated walls.

In FIG. 10 a jumbo cargo aircraft 46 is depicted carrying four large rectangular containers 38 on its cargo floor 47. These containers 38 have partially pleated side walls 40 which permit the walls to incrementally extend or contract vertically and consequently increase the flexibility of the cargo container floor 44. Arrows 48 and 50 show the direction of possible deflection of the foreward fuselage section and the aft fuselage section, respectively, around the wing axis 51. The bending of the fuselage in the direction of arrows 48 and 50 causes the aircraft cargo floor 47 to assume a concave or convex configuration which the flexible cargo container floor 44 is designed to match.

To adjust the flexure of a container floor pleats may cover an entire container wall as in FIG. 3 or a portion of the container wall as in FIG. 9. The flexure can also be adjusted by varying the width or depth of the pleat or the height of the pleat. Tapered pleats as shown in FIGS. 3 and 9 minimize weight, simplify end joints as well as permit a greater flexure at the center of the pleated wall to accommodate the greatest deflection of the bottom of the cargo container. The pleats, however, can be constructed of uniform dimensions across the entire side wall of the container.

Figure 11:
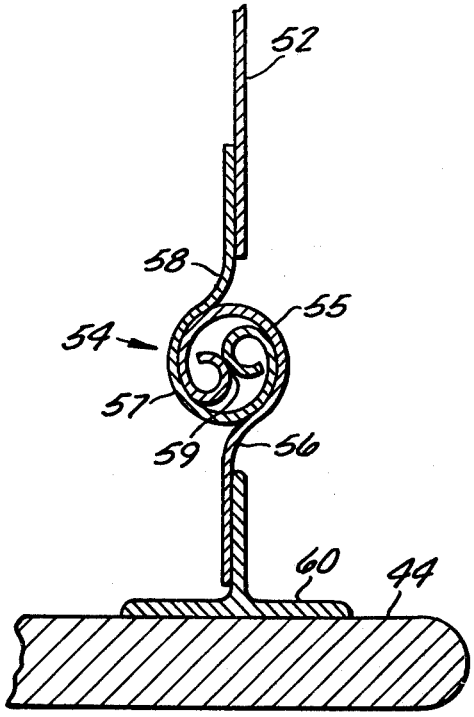
FIG. 11 is a vertical section through a portion of a container wall constructed in accordace with the present invention depicting a single spring joint.

A container can be constructed (FIG. 11) with side walls 52 of an alternative embodiment which has distortable spring joints 54 running parallel to the floor 44 of the container. FIG. 11 depicts a portion of such a container with a floor 44, side wall 52 and distortable spring joint 54. The spring joint 54 is constructed of two coiled spring panels which run the length of the wall 52 and parallel to the floor 44. The lower spring panel 56 is shown attached to the floor 44 of the container through T-shaped member 60. Upper spring panel 58 is attached to side wall 52 which is in turn attached to the top of the container.

Upper spring panel 58 is constructed with a spiraling curved lower surface 57. Lower spring panel 56 is constructed with a spiraling curved upper surface 55. These two spiraling curved surfaces 55 and 57 dovetail together with the terminal edges overlapping and abuting 59 to provide stiffness to the spring joints 54.

When the floor 44 of the container is deflected, the spring joint 54 located in the side wall 52 can extend or contract to accommodate a curvature in the container floor. Due to the overlapping curvature of the upper and lower spring panels, said panels engage each other to provide a solid wall whether the floor flexes upward or downward.

Figure 12:
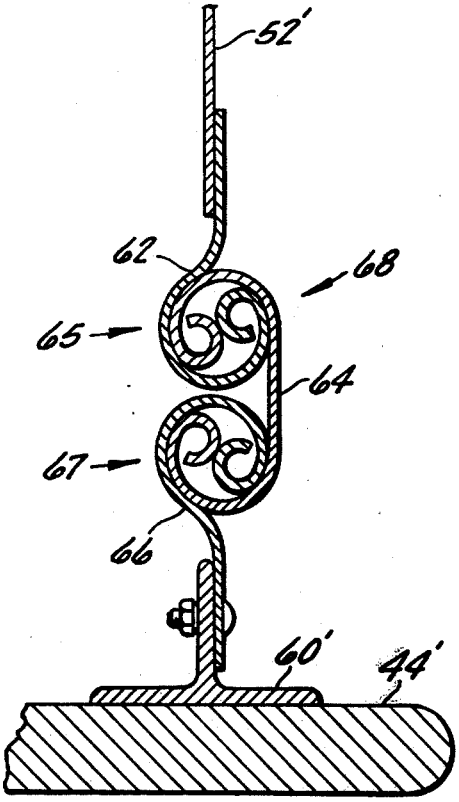
FIG. 12 is a vertical section through a portion of a container wall constructed in accordance with the present invention depicting a double spring joint.

The spring panels may be constructed integrally with the side wall (not shown), may be constructed separately as in FIG. 11 and welded into position, riveted (not shown), or may be bolted into position as shown in FIG. 12.

FIG. 12 depicts a double spring joint, which joint gives even greater flexibility to a side wall 52' of a container. The three spring members provide a pair of joints 65 and 67 that can expand or contract and permit the side wall 52' to accommodate a deflection of the floor 44'. In FIG. 12 the side wall 52' is attached to the first spring member 62 which dovetails together with second spring member 64. The terminal edges of spring members 62 and 64 overlap and abut to form a first spring joint 65 similar in construction and operation to the joint 54 of FIG. 11.

Second spring member 64 and third spring member 66 dovetail together with their terminal edges overlapping and abutting to form a second spring joint 67 which is similar in construction and operation to the joint 54 of FIG. 11. Third spring member 66 is attached to container floor 44' through T-shaped member 60'.

The double spring joint 68 as shown in FIG. 12 runs the length of the side wall and parallel to the floor 44' of the container and can incrementally distort along its length to accommodate flexure of the cargo container floor 44'.

While certain exemplary embodiments of this invention have been described above and shown in the accompanying drawings, it is to be understood that such embodiments are merely illustrative of, and not restrictive on, the broad invention and that I do not desire to be limited in my invention to the specific constructions or arrangements shown and described, since various other obvious modifications may occur to persons having ordinary skill in the art and it is to be understood that those modifications are to be construed as part of the present invention.

What is claimed is:

1. An enclosed solid four-sided cargo container comprising:

a top, a bottom, a first set of two rigid opposing walls attached to said top and bottom providing support for the top, a second set of two opposing walls attached to the top and to the bottom comprising distortable pleats which vary in width, said pleats having their greatest width at the center of the wall, the width of the pleats decreasing in both directions toward the side edge of the wall to zero depth, providing a flat surface at the edge of the wall, said pleats orientated parallel to the bottom to impart pliability to said second set of walls in a direction perpendicular to said bottom, whereby said walls permit incremental flexure of the bottom of the container along the line of contact between the second set of walls and the bottom of the container.

2. The enclosed solid four-sided container of claim 1 having telescoping support beams attached to the top and the bottom, said beams positioned parallel and adjacent to the outside of the second set of walls, said beams providing additional support for said walls in a direction perpendicular to said walls.

3. An enclosed solid four-sided cargo container comprising:

a top, a bottom, a first set of two opposing rigid walls attached to the top and the bottom providing support for the top, a second set of two opposing walls attached to the top and to the bottom comprising a distortable spring joint orientated parallel to the bottom, said joint being constructed of two coiled spring panels which dovetail together, the terminal edges of which overlap and abut to provide pliability in a direction perpendicular to the bottom, said second set of walls permit incremental flexure of the bottom of the container along the line of contact between the second set of solid walls and the bottom of the container.

* * * * *